United States Patent [19]

Putnam

[11] Patent Number: 4,888,830

[45] Date of Patent: Dec. 26, 1989

[54] QUICK RELEASE ADJUSTABLE TENSION STRAP

[76] Inventor: Allen L. Putnam, 4350 Ryan Way #1, Carson City, Nev. 89706

[21] Appl. No.: 281,803

[22] Filed: Dec. 8, 1988

[51] Int. Cl.[4] ..... A41F 9/00

[52] U.S. Cl. ..... 2/327; 2/DIG. 6

[58] Field of Search ..... 2/305, 311, 312, 321, 2/322, 325, 327, DIG. 6; 24/306, 442, 182, 193, 200

[56] References Cited

U.S. PATENT DOCUMENTS 4,527,289 7/1985 Shea ..... 2/322

4,715,364 12/1987 Noguchi ..... 2/311

*Primary Examiner*—Ronald Feldbaum

*Attorney, Agent, or Firm*—Stetina and Brunda

[57] ABSTRACT

An improved releasable tension strap is disclosed. A main strap is provided with a connector strap segment attached thereto and extending generally outwardly therefrom. One end of the main strap bears a first connecting means, while one surface of the connector strap segment bears a second connecting means compressively joinable with the first connecting means. Accordingly, the end of the main strap may be drawn through a closed-loop connector to a point where a desired degree of tension is exerted thereon. The main strap end may then be compressively joined with the connector strap segment thereby preventing retraction of the main strap through the closed-loop connector. Thus the main strap end is automatically fastened and never long or loose. Additionally, the connector strap segment may be slidably adjustable on the main strap so as to permit convenient adjustment thereof. One preferred embodiment incorporates the invention into a suspender-like over-the-shoulder strap for holding sportsmen's waders and other garments.

16 Claims, 1 Drawing Sheet

Fig. 1
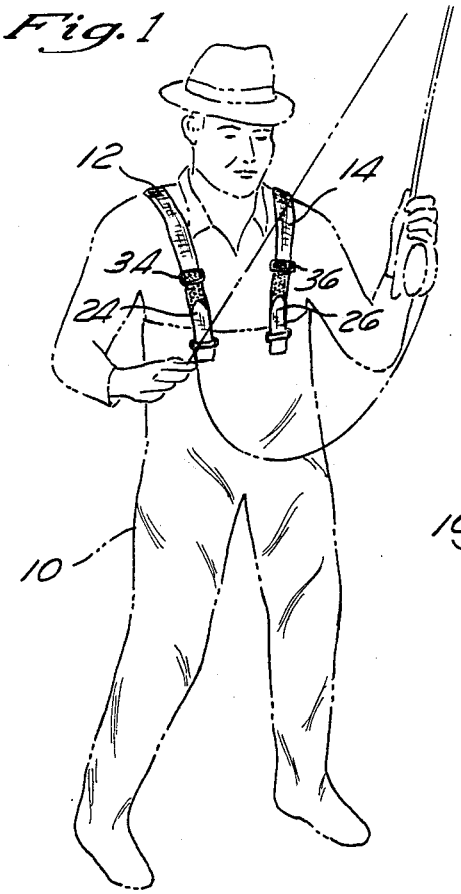
Fig. 2
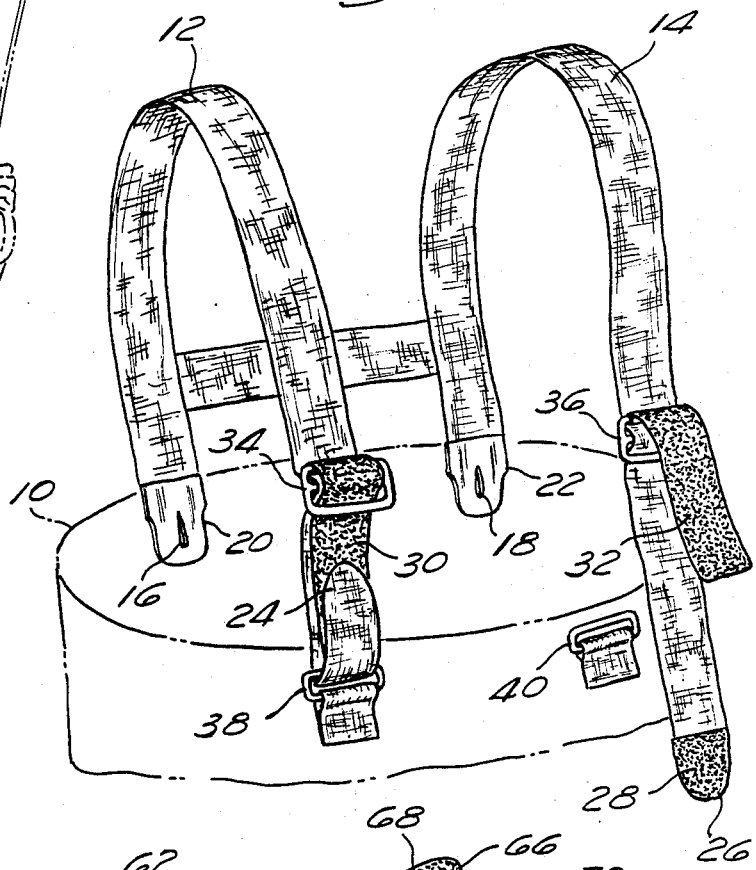
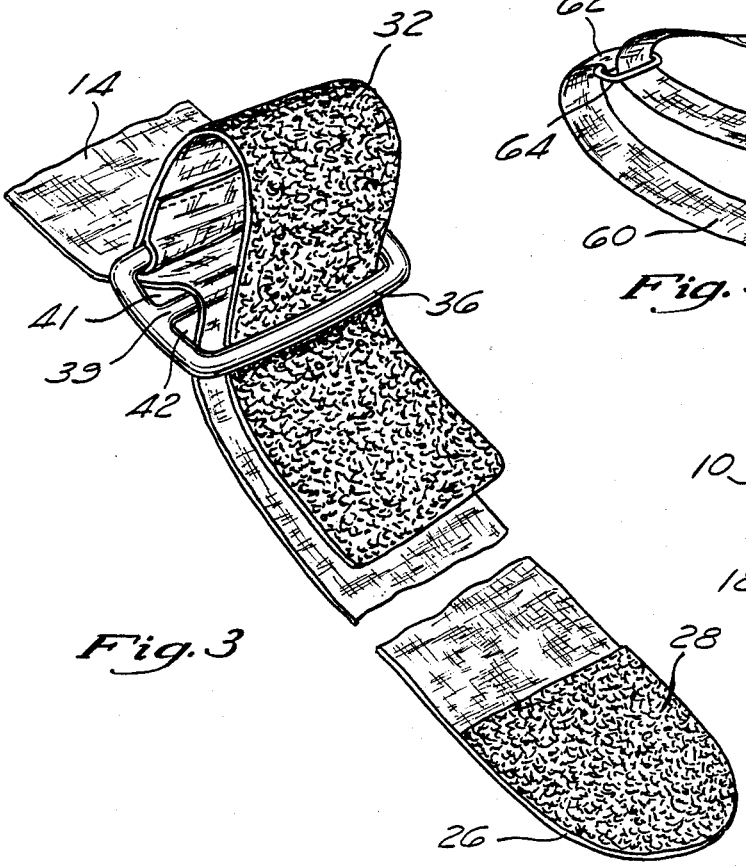
Fig. 3
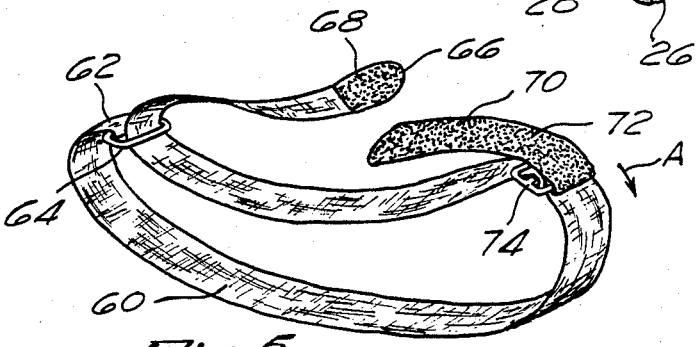
Fig. 5
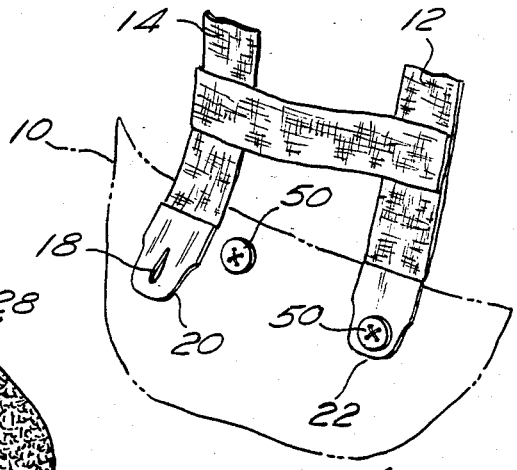
Fig. 4

QUICK RELEASE ADJUSTABLE TENSION STRAP

This invention pertains generally to an attachable and releasable strap device for exerting tension on a desired object or objects. More particularly the invention provides either an easily releasable and adjustable strap device for miscellaneous use or a suspender-like strap device for use with articles of clothing, such as sportsmen's waders wherein over the shoulder retention straps are desirable.

Because the invention is particularly useful in connection with sportsmen's waders, it will be described herein with particular reference thereto. However, it will be appreciated that the tension strap device of the present invention has extremely broad applicability and may be used in virtually any application wherein an easily attachable, releasable and/or adjustable strap is required to exert tension on or around an object.

BACKGROUND OF THE INVENTION

Conventional tensioning straps of the prior art have incorporated and combined various arrangements of buckles and other gripping mechanisms to achieve a desired combination of easy attachability and releasability and a necessary degree of adjustability.

Specifically, with respect to sportsmen's waders, the typical suspender-like tensioning straps of the prior art are routinely connectable to the front and back of the waders by means of buttons, clamps, or other releasable connecting means The tension exerted by such conventional over-the-shoulder straps may then be adjusted by sliding or otherwise manipulating one or more clasp-type adjustment mechanisms located along and fixed to the straps themselves In order to remove the waders when such conventional strap arrangements are employed, it is necessary for the user to first remove any garment worn over the top thereof and to subsequently unbutton or otherwise disconnect the straps from the front and/or rear of the waders before removing them. Even where snap-like connectors are employed it is generally necessary for the wearer to use both hands to effect connection and disconnection of the straps. Moreover, disconnection of many connectors used on sportsmen's waders may require a level of finger strength which may be uncommon to children and some adults.

In certain emergency situations, such as when the waders have become filled with water, it is desirable to minimize the amount of handling and manipulation required in order to release the retention straps and free the wearer from the waders.

Typical belt straps adjust by pulling the strap through a buckle until the desired tension is achieved. This leaves the strap end loose and often too long for neat appearance and safety. The present invention automatically closes the straps end so it is always neat appearing and never a danger of a loose strap entangling for such users as bikers, climbers, etc.

In view of the above-described shortcomings of the prior art there remains a substantial need for a simple, versatile and inexpensive tension strap capable of rapid connection, adjustment, and disconnection.

BRIEF DESCRIPTION OF THE INVENTION

The present invention contemplates a new and improved tension strap whereby connection, tension adjustment, and disconnection of the strap may be accomplished in minimal time and with a minimum of direct handling by the user.

In accordance with one aspect of the invention, the strap device may comprise a flexible main strap attached at one end to a desired object. The opposite end of the main strap is provided with a first connecting means capable of being firmly yet releasably joined to a corresponding second connecting means. A separate connector strap segment is connected to a point on the main strap. The separate connector strap segment carries the afore-mentioned second connecting means which is generally analogous to the first connecting means located on the free end of the flexible main strap. A closed-loop connector is attached to the desired object such that the free end of the main strap may be drawn through the closed-loop connector until a desired degree of tension is exerted thereon. The free end of the main strap will then be placed in contact with the connector strap segment such that the first connecting means located on the free end of the main strap will be compressively joined with the second connecting means located on the separate connector strap segment. Provided that the separate connector strap segment has been properly positioned on the main strap, the connection of the main strap to the connector strap segment will serve to hold the main strap under the desired degree of tension and length. Also, so long as the main strap remains connected to the connector strap, there will be no loose strap ends to become entangled or unsightly. The desired degree of tension on the strap will be maintained until such time as the first and second connecting means are separated, thereby releasing the free end of the main strap and permitting reverse retraction thereof with a resultant relaxation of the tension exerted on the object.

In accordance with another aspect of the invention, the connector strap segment may be attached to the main strap in a manner which permits positional adjustment of the connector strap segment to attain a desired strap length and tension. As a means of achieving such adjustability, one end of the connector strap segment may be slidably connected to the body of the main strap. Additionally, such slidable connection may include a locking feature whereby the connector strap segment will be held in its desired position on the body of the main strap, without undesired slippage, until the user choses to disconnect the free end of the main strap from the connector strap segment, thereby permitting retraction of the main strap and a resultant relaxation of tension thereon.

In accordance with a further aspect of the invention, the inventive device may be in the form of a unitary strap suitable for positioning around a single object or a collection of objects which the user wishes to hold in a bundle-like configuration. In such embodiment the closed-loop connector need not be directly attached to the object to be held by the tension strap. Instead, the closed-loop connector may be connected directly to a point on the main strap, thereby providing a tensioning strap which is suitable for miscellaneous use. In such an embodiment, the closed-loop connector will likely be attached to the main strap at the end opposite the free end whereon the first connecting means is positioned. Accordingly, the main strap may be initially placed around the desired object. The free end of the main strap may then be pulled through the closed-loop connector located at the other end of the strap until the desired degree of tension has been obtained. The free end of the main strap may then be connected to the connector strap segment so as to prevent relaxation of the main strap until such time as the user chooses to disconnect the same. Also, so long as the free end of the main strap remains connected to the connector strap, there will be no unsightly loose strap ends to become entangled or caught.

In accordance with a still further aspect of the invention the first and second connection means may comprise Velcro pads, snaps, or any other joinable but releasable connecting means.

One principal object of the invention is to provide an improved tension strap capable of being quickly and easily attached and/or released with a minimal degree of handling and manipulation.

Another object of the invention is to provide a releasable tensioning strap of the foregoing character wherein the length of the strap and the resultant tension exerted thereon is quickly and easily adjustable.

Yet another object of the invention is to provide a tensioning strap which will be neat in appearance and will have no loose ends hanging away from the strap so as to become caught or entangled.

Still another object of the invention is to provide an improved suspender design for use with hunting and fishing waders, trousers, and other garments. The improved suspenders of the present invention are intended to achieve neat appearance, quick and easy attachment, release, and adjustability.

A further object of the invention is to improve the safety of hunting and fishing waders by providing an over-the-shoulder tensioning strap which may be rapidly released in an emergency and which would not require preliminary removal of articles of clothing worn over the top of the strap or the application of force exceeding the normal hand strength of children and elderly persons.

A still further object of the invention is to improve the safety of hunting and fishing waders by providing an around the waist belt that will prevent water from quickly filling the waders thus trapping air and giving enough time to recover to safety yet is quickly removed when necessary. Such a strong yet quick release belt is also desired by the water skiers and other outdoor users.

An even further object of the invention is to provide a tensioning strap for miscellaneous use, such strap being positionable around one or more objects so as to exert tension thereon. Such strap is intended to be particularly usable in holding one object in contact with another or in retaining a plurality of objects in a bundle-like fashion.

Further objects and advantages of the invention will become apparent to those skilled in the art upon reading of the following detailed description and consideration of the accompanying drawings.

BRIEF DESCRIPTION OF THE DRAWINGS

FIG. 1 is a perspective view of a user wearing sportsmen's waders which incorporate over-the-shoulder suspender-like tension straps of the present invention;

FIG. 2 is a perspective view of over-the-shoulder straps of the present invention;

FIG. 3 is an enlarged perspective view of a portion of one adjustable tension strap of the present invention;

FIG. 4 is a perspective view showing the manner in which over-the-shoulder tensioning straps of the present invention may be connected to the rear of a pair of sportsmen's waders; and FIG. 5 is a perspective view of a belt-like tensioning strap of the present invention intended for miscellaneous use.

DESCRIPTION OF THE PREFERRED EMBODIMENT

Referring now to the drawings wherein the showings are for purposes of illustrating the preferred embodiments of the invention only and not for purposes of limiting the same, FIGS. 1 through 4 are directed to an over-the-shoulder suspender-like embodiment of the invention while FIG. 5 shows an alternative embodiment in the form of a utility strap suited to various applications.

In FIG. 1, a user is shown to be wearing sportsmen's waders 10 having two separate adjustable over-the-shoulder tensioning straps 12 and 14. As shown, the tensioning straps of the present invention, when connected, hold all loose ends of the strap firmly in place so as to be neat in appearance and not to become entangled or caught.

The particular elements of the present invention may be more fully appreciated from the enlarged view of FIG. 2. As shown in FIG. 2, the over-the-shoulder straps 12 and 14 are connectable to the back of the waders 10 by way of button hole connectors 16 and 18 located at the first longitudinal ends 20 and 22 of straps 12 and 14, respectively. The opposite longitudinal ends 24 and 26 of straps 12 and 14 are provided with first connecting means comprising a pad of hook or loop type connecting (e.g. Velcro) material 28. A corresponding second connecting means, also comprising a pad of loop Velcro material, is located on the upper surface of each connecting strap segment 30, 32. The connective strap segments 30 and 32 are slidably connected to main straps 12 and 14 by way of slidable connectors 34 and 36. The slidable connectors 34 and 36 may be slidably advanced in either direction along main straps 12 and 14 thereby permitting the user to adjust the tension on main straps 12 and 14 after they have been fully connected as described herein. When the main straps have been drawn to a generally desirable tension, the slidability of connectors 34 and 36 will thereafter be impeded. thus, the connector strap segments 30 and 32 will be prevented from slipping from their preadjusted positions. By such arrangement, the desired tension will be maintained until such time as the user chooses to release the connection between the free ends of main straps 12, 14 and the connector strap segments 30, 32.

Closed-loop connectors 38 and 40 are positioned on the front of waders 10 to permit the free ends 24 and 26 of main straps 12 and 14 to be drawn therethrough. After the free ends 24 and 26 of main straps 12 and 14 have been drawn through closed-loop connectors 38 and 40, the free ends 24 and 26 will be drawn upwardly. The hook Velcro pads 28 located thereon will be compressively joined with the corresponding loop Velcro surfaces of connecting strap segments 30 and 32. The connecting strap segments 30 and 32 may then be slidably advanced along the body of the main strap until the desired tension is reached. Thereafter, so long as the free ends 24, 26 of main straps 12, 14 remain joined to connecting strap segments 30, 32, there will be no loose strap porion to become caught or entangled. Instead, the connected tensioning strap will be uniform and neat in appearance.

The slidable connecting member 36 by which the desired adjustability and tension regulating effects are achieved is shown in the enlarged view of FIG. 3. The connector strap segment 30 having its loop Velcro outer surface is connected at one end to the slidable connector member 36 and is tucked in underneath the opposite side of the connector 36 such that a raised portion of the connecting strap segment 32 is exposed on the front side of main strap 14. A corresponding hook Velcro pad 28 is disposed on the upper surface of the free end 26 of main strap 14. Thus, the "first connecting means" is the hook Velcro pad 28 at the end 26 of the main strap means while the "second connecting means" is the loop Velcro surface of connecting strap segment 32.

The connecting member 36 is a generally rectangular closed-loop structure having a friction bar 38 extending centrally thereacross. The flexible main strap is passed through a first aperture 40 of the connecting member, over the friction bar 38 and back through the second aperture 42 of the connecting member. The body of the main strap is sized in relation to the connecting member 36 so as to firmly frictionally engage the connecting member 36 in its non-tensioned state. Accordingly, under usual conditions, slidable adjustment of the connecting member 36 along the body of the main strap requires sufficient manual pressure to move the connecting member 36 therealong. Ease and speed of moving connecting member 36 on straps 12, 14, is obtained by tilting buckle 36 out of alignment with straps 12,14 so friction and compression is reduced.

Likewise, the connecting member 36 may also function to automatically regulate the degree of tension on the main strap 14. If the flexible main strap 14 is formed of elastic or expandable material and placed under excessive tension it will stretch. When the body of the main strap 14 stretches, the width and thickness of the strap body will decrease slightly. As a result, the slidable connecting member 36 may become more slidable along the main strap in a direction which will decrease the tension of the main strap 14. When the connecting member 14 reaches a point where the elastic body of the strap is no longer stretched, the connecting member 36 will once again grip the strap body and will serve to hold the attendant connector strap segment 32 at such position. Thus, the arrangement shown in FIG. 3 may function to automatically relieve over-tensioning of the strap.

The manner in which the wader straps of the present invention are connected to the back of the waders 10 may be fully appreciated from FIG. 4 wherein straps 14 and 12 are provided with button hole connectors 18 at their terminal ends 20 and 22. As shown, the buttons 50 and 52 are sewn to the back of waders 10 so as to connect to button hole means 18 thereby securing over-the-shoulder straps 12 and 14 firmly to the back of the waders 10.

FIG. 5 shows an alternative embodiment of the present invention comprising a miscellaneous utility strap 60 adapted for quick attachment, easy adjustable tensioning and quick release. A closed-loop connector 64 is connected to one longitudinal end 62 of the strap 60. The opposite end 66 of strap 60 is provided with a first connecting means comprising a hook Velcro pad 68. A separate connecting strap segment 70, bearing a corresponding loop Velcro surface 72, is slidably connected to strap 60 via slidable connection means 74.

Thus, strap 60 may be positioned around a desired object and, thereafter, the free end 66 may be drawn through the closed-loop connector 64, doubled back over a portion of strap 60, and finally connected to the connecting strap segment 70 by way of hook and loop Velcro connecting means 68 and 72, respectively. When so connected, the free end 66 is held firmly in place so that no loose end is left hanging or dangling in an unsightly manner which may become entangled or caught.

Prior to or immediately after such connection is made, the slidable connecting member 74 may be slidably advanced in the direction indicated by arrow A to a point where a desired degree of tension is exerted on strap 60. As discussed above with respect to FIG. 3, connecting member 74 slides more easily for adjustability when the hand tilts the buckle out of alignment reducing tension on strap 60.

Optionally, if the strap 60 is made of sufficiently sized and stretchable elastic material it may "self adjust" in instance where too much tension is applied and the elastic body of the main strap becomes extended to a stretched configuration. However, such optional "self-adjustment" will occur only to a point where the main strap is no longer substantially stretched. Thereafter the connecting member will once again frictionally engage or grip the main strap body and the present degree of tension on strap 60 will be maintained.

When quick release of the strap is desired, the free end 66 is simply pulled away from connecting strap segment 70 so as to separate Velcro pads 68 and 72, thereby permitting the free end 66 of strap 60 to be retracted through closed-loop connector 64 relieving the tension on the strap and releasing any object contained therein.

Thus, in summary, the present invention provides an easily adjustable and quickly attachable/releasable strap which may be physically adapted for use as suspender-like tensioning straps for connection to sportsmen's waders and other similar garments. Also, the tensioning strap of the present invention may take physical form as a belt-like utility strap adapted for placement around an object or bundle of objects to be secured.

Those skilled in the art will recognize that, although specific materials, sizes, and structures has been depicted herein, many modifications to such materials, sizes, and structures may be made without departing from the spirit and scope of the invention and such modifications are fully contemplated herein.

What is claimed is:

1. A releasable strap device for exerting tension on a desired object, said strap device comprising:

a flexible main strap having a first longitudinal end and a second longitudinal end, said first longitudinal end being attached to the desired object and said second longitudinal end being generally provided with a first connecting means, said first connecting means being compressively yet releasably conjoinable with an analogous second connecting means;

a connector strap segment attached to a point on said main strap, said connector strap segment being provided with said second connecting means compressively conjoinable with said first connecting means;

a closed-loop connector attached at a point on the desired object, said closed loop connector being positioned, sized, and configured to permit said main strap may be longitudinally drawn therethrough to a desired point at which said first connecting means may be compressively conjoined with said second connecting means to prevent return movement of said main strap through said closed-loop connector until such time as said first connecting means is detached from said second connecting means.

2. The releasable strap device of claim 1 wherein said connector strap segment is slidably attached to said main strap so as to be slidably adjustable thereon.

3. The releasable strap device of claim 2 wherein said slidable connection of said connector strap segment to said main strap is accomplished by a slidable connecting member, said connecting member comprising:

a rigid, generally rectangular closed-loop structure having a solid friction bar extending thereacross so as to define a first aperture on one side of said friction bar and a second aperture on the other side of said friction bar;

said connecting strap segment being firmly attached at one end to said connecting member; and said main strap being passed through said first aperture of said connecting member, over said friction bar and through said second aperture such that said connecting member, with said connecting strap segment attached thereto, will be slidably movable along said main strap between said first and second longitudinal ends thereof.

4. The releasable strap device of claim 3 wherein said main strap is made of an elastic material.

5. The releasable strap device of claim 4 wherein said elastic main strap may be alternately stretched and unstretched and said connecting member is relatively sized and configured such that said generally unstretched main strap will be frictionally gripped within said connecting member, thereby impeding slidable movement thereof until such time as said elastic main strap becomes sufficiently stretched so as to lessen the frictional grip of said connecting member on said main strap, thereby permitting easy slidable movement thereof until said main strap returns to its generally unstretched configuration.

6. The releasable strap device of claim 1 wherein said first and second connecting means comprise corresponding pads bearing a multiplicity of hook and eye connectors which are sized, configured, and positioned so as to render said pads compressively conjoinable with one another.

7. The releasable strap device of claim 1 wherein said first and second connecting means comprise at least one snap-type connector.

8. A releasable strap device for placement around and exertion of tension upon a desired object, said strap device comprising:

a flexible main strap having a first longitudinal end and a second longitudinal end;

a closed-loop connector connected to said main strap at said first longitudinal end;

a first connecting means position on said main strap at said second longitudinal end, said first connecting means being compressively conjoinable with a corresponding second connecting means;

a connector strap segment attached to a point on said main strap, said connector strap segment being provided with said second connecting means which is compressively conjoinable with said first connecting means; and said releasable strap device being sized and adapted so as to be positionable around the desired object such that said second longitudinal end may be drawn through said closed-loop connector until a desired degree of tension has been exerted on said main strap and thereafter said first connecting means may be compressively conjoined with said second means to prevent retraction of said main strap through said closed-loop connector until such time as said first connecting means is detached from said second connecting means.

9. The releasable strap device of claim 8 wherein said connector strap segment is slidably attached to said main strap so as to be slidably adjustable thereon.

10. The releasable strap device of claim 9 wherein said slidable connection of said connector strap segment to said main strap is accomplished by a slidable connecting member, said connecting member comprising:

a rigid, generally rectangular closed-loop structure having a solid friction bar extending thereacross so as to define a first aperture on one side of said friction bar and a second aperture on the other side of said friction bar;

said connecting strap segment being firmly attached at one end to said connecting member; and said main strap being passed through said first aperture of said connecting member, over said friction bar and through said second aperture such that said connecting member, with said connecting strap segment attached thereto, will be slidably movable along said main strap between said first and second longitudinal ends thereof.

11. The releasable strap device of claim 10 wherein said main strap is made of an elastic material.

12. The releasable strap device of claim 11 wherein said elastic main strap may be alternately stretched and unstretched and said connecting member is relatively sized and configured such that said generally unstretched main strap will be frictionally gripped within said connecting member, thereby impeding slidable movement thereof until such time as said elastic main strap becomes sufficiently stretched so as to lessen the frictional grip of said connecting member on said main strap, thereby permitting easy slidable movement thereof until said main strap returns to its generally unstretched configuration.

13. The releasable strap device of claim 8 wherein said first and second connecting means comprise corresponding pads, each bearing a multiplicity of hook and eye connectors which are sized, configured, and positioned so as to render said pads compressively conjoinable with one another.

14. The releasable strap device of claim 8 wherein said first and second connecting means comprise at least one snap-type connector.

15. The releasable strap device of claim 8 wherein connection of said main strap to said connecting strap segment is made in such a manner as to hold said main strap in a taunt configuration thereby preventing said main strap from remaining loose and dangling in an unconnected manner.

16. The releasable strap device of claim 1 wherein connection of said main strap to said connecting strap segment is made in such a manner as to hold said main strap in a taunt configuration thereby preventing said main strap from remaining loose and dangling in an unconnected manner.

* * * * *